US008920116B2

(12) United States Patent
Wiebe et al.

(10) Patent No.: US 8,920,116 B2
(45) Date of Patent: Dec. 30, 2014

(54) WEAR PREVENTION SYSTEM FOR SECURING COMPRESSOR AIRFOILS WITHIN A TURBINE ENGINE

(75) Inventors: David J. Wiebe, Orlando, FL (US); Adam C. Pela, Jupiter, FL (US)

(73) Assignee: Siemens Energy, Inc., Orlando, FL (US)

( * ) Notice: Subject to any disclaimer, the term of this patent is extended or adjusted under 35 U.S.C. 154(b) by 614 days.

(21) Appl. No.: 13/267,954

(22) Filed: Oct. 7, 2011

(65) Prior Publication Data

US 2013/0089417 A1 Apr. 11, 2013

(51) Int. Cl.
*F01D 5/16* (2006.01)
*F01D 25/06* (2006.01)
*F01D 25/24* (2006.01)

(52) U.S. Cl.
CPC ..... *F01D 25/246* (2013.01)
USPC ..... 415/209.3; 415/191

(58) Field of Classification Search
USPC ..... 415/191, 199.1, 199.4, 199.5, 208.1, 415/208.2, 209.3, 209.4, 210.1
See application file for complete search history.

(56) References Cited

U.S. PATENT DOCUMENTS 2,950,084 A * 8/1960 Perry ..... 415/160
3,146,992 A * 9/1964 Farrell ..... 415/12
3,326,523 A * 6/1967 Bobo ..... 415/209.3
3,601,414 A * 8/1971 Rao ..... 165/9
3,619,077 A * 11/1971 Wile et al. ..... 415/115
3,719,427 A * 3/1973 Davis ..... 415/147
3,857,649 A * 12/1974 Schaller et al. ..... 415/200
3,887,299 A * 6/1975 Profant ..... 415/173.4
3,966,353 A * 6/1976 Booher et al. ..... 415/115
3,990,810 A * 11/1976 Amos et al. ..... 415/161
4,053,254 A * 10/1977 Chaplin et al. ..... 415/116
4,245,954 A * 1/1981 Glenn ..... 415/200
4,314,792 A * 2/1982 Chaplin ..... 415/116
4,363,600 A * 12/1982 Thebert ..... 415/156
4,537,024 A * 8/1985 Grosjean ..... 60/791
4,604,030 A * 8/1986 Naudet ..... 415/126
4,632,634 A * 12/1986 Vinciguerra et al. ..... 415/139
4,642,024 A * 2/1987 Weidner ..... 415/116
4,897,021 A * 1/1990 Chaplin et al. ..... 415/173.7
5,429,479 A * 7/1995 Cordier ..... 415/209.3
5,803,710 A 9/1998 Dietrich et al.
5,868,398 A * 2/1999 Maier et al. ..... 277/643
6,761,538 B2 * 7/2004 Fitts et al. ..... 416/221
6,932,566 B2 * 8/2005 Suzumura et al. ..... 415/135
7,291,946 B2 * 11/2007 Clouse et al. ..... 310/51
7,434,670 B2 * 10/2008 Good et al. ..... 188/380
7,445,426 B1 * 11/2008 Matheny et al. ..... 415/135
7,556,475 B2 * 7/2009 Roberts et al. ..... 415/173.1
8,105,016 B2 * 1/2012 Butz et al. ..... 415/119
2010/0074731 A1 3/2010 Wiebe et al.
2010/0196155 A1 * 8/2010 Twell ..... 415/209.3

* cited by examiner

*Primary Examiner* — Edward Look
*Assistant Examiner* — Wayne A Lambert

(57) ABSTRACT

A wear prevention system for securing compressor airfoils within a turbine engine while reducing wear of related components may include a compressor diaphragm spring positioned in an airfoil receiving channel between a radially outer surface of a diaphragm base and a radially inner surface of the airfoil receiving channel. The spring may bias the diaphragm base and airfoil attached thereto radially inward against upstream and downstream arms formed from upstream and downstream recesses extending axially from the airfoil receiving channel in the compressor case. The compressor diaphragm spring may dampen vibration and increase service life of the diaphragm base.

6 Claims, 4 Drawing Sheets

WEAR PREVENTION SYSTEM FOR SECURING COMPRESSOR AIRFOILS WITHIN A TURBINE ENGINE

FIELD OF THE INVENTION

This invention is directed generally to turbine engines, and more particularly to compressor vane attachment systems in turbine engines.

BACKGROUND

Typically, gas turbine engines include a compressor for compressing air, a combustor for mixing the compressed air with fuel and igniting the mixture, and a turbine blade assembly for producing power. The compressor blade assembly typically includes a rotor assembly rotatable positioned in a turbine compressor case and having a plurality of compressor blades extending radially outward from the rotor assembly. The turbine engine also includes a plurality of stationary compressor vanes, which are also referred to as diaphragm airfoils 4 attached to diaphragms 2, extending radially inward from the turbine compressor case 6. The compressor blades and compressor vanes 4 are aligned into rows, or stages, and are positioned in alternating rows of vanes and blades. The compressor vanes 4 are typically attached to a turbine compressor case 6 via a hook fit 8, as shown in cross-section in FIGS. 1 and 2. The hook fit releasably and securely attaches the compressor vanes 4 within a turbine engine. During operation, the hooks fits 8 are susceptible to wear due to vibration, heat, and other factors. For instance, a hook fit 8 is typically worn in the areas 7 shown in FIG. 2. Such wear negatively affects the safety and efficiency of a turbine engine in which the wear occurs.

Typically, such wear regions 7 are repaired on turbine engines during outages in which other aspects of the turbine engine are repaired. Repairing the diaphragm 2 and related components generally takes weeks because of the time needed to remove half of the compressor case 6 to gain access. Thus, a need exists for extending the useful life of the diaphragm and relevant portions of the compressor case forming the hook fit of a turbine engine.

SUMMARY OF THE INVENTION

This invention is directed to a wear prevention system for securing compressor airfoils within a turbine engine to reduce wear on diaphragm components used to secure the compressor airfoils. Diaphragm bases may be configured to support airfoils, such as compressor vanes, extending radially inward. The diaphragm bases may be contained within one or more airfoil receiving channels in the compressor case. The diaphragm bases may be biased radially inward within the airfoil receiving channel though use of a compressor diaphragm spring to dampen vibration. Use of the compressor diaphragm spring reduces wear on the inner surfaces of the airfoil receiving channel of the compressor case, thereby increasing the time between servicing.

The wear prevention system for securing compressor airfoils within a turbine engine may include a generally cylindrical compressor case having at least one airfoil receiving channel. The airfoil receiving channel may be positioned in an inner surface the generally cylindrical compressor case such that the inner surface includes an opening for receiving a diaphragm supporting an airfoil. The least one airfoil receiving channel may include an upstream recess and a downstream recess. The upstream recess may be formed from a generally curved, upstream arm that extends axially downstream and has an inner surface that is aligned with and forms a portion of the inner surface of the generally cylindrical compressor case. The downstream recess may be formed from a generally curved, downstream arm that extends axially upstream and has an inner surface that is aligned with and forms a portion of the inner surface of the generally cylindrical compressor case. The wear prevention system may include at least one diaphragm base that is curved about a longitudinal axis and that extends from the upstream recess to the downstream recess with an upstream radially outward support surface and a downstream radially outward support surface. An airfoil may extend radially inward from the diaphragm base. A compressor diaphragm spring may be positioned in the airfoil receiving channel between a radially outer surface of the diaphragm base and a radially inner surface of the at least one airfoil receiving channel. The compressor diaphragm spring may impart a force radially inward on the diaphragm base to dampen vibration of the diaphragm base and the airfoil.

In one embodiment, the compressor diaphragm spring may extend axially from the upstream radially outward support surface of the diaphragm base to the downstream radially outward support surface of the diaphragm base. The compressor diaphragm spring may include an upstream inner support pad that is configured to mate with the upstream radially outward support surface and may include a downstream inner support pad that is configured to mate with the downstream radially outward support surface. The upstream and downstream inner support pads may extend radially inward further than other aspects of the compressor diaphragm spring. A radially outward engagement pad may extend radially outward from the compressor diaphragm spring. The radially outward engagement pad may extend radially outward from the compressor diaphragm spring further than other aspects of the compressor diaphragm spring, contact the radially inner surface of the airfoil receiving channel, and deflect radially inward. The compressor diaphragm spring may be curved about a longitudinal axis and may be curved about an axis orthogonal to the longitudinal axis.

In another embodiment, the compressor diaphragm spring may be formed from a rod extending radially inward from the compressor case into the airfoil receiving channel and wherein the compressor diaphragm spring is biased radially inward. A releasable housing that contains at least a portion of the rod may be releasably attached to the compressor case. A spring may be positioned between the releasable housing and a radially outer surface of the rod. In one embodiment, the spring may be a coil spring. The releasable housing may include a plurality of threads extending axially outward that engage corresponding threads on a side wall forming a chamber within the compressor case. A sacrificial wear material may be positioned on a radially inner surface of the rod.

An advantage of this invention is that the restoration system compressor diaphragm spring may be positioned in the airfoil receiving channel between a radially outer surface of the diaphragm base and a radially inner surface of the airfoil receiving channel to impart a force radially inward on the diaphragm base. As such, the rate of wear on the diaphragm base and compressor case may be reduced, thereby extending the usable life between servicing outages.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
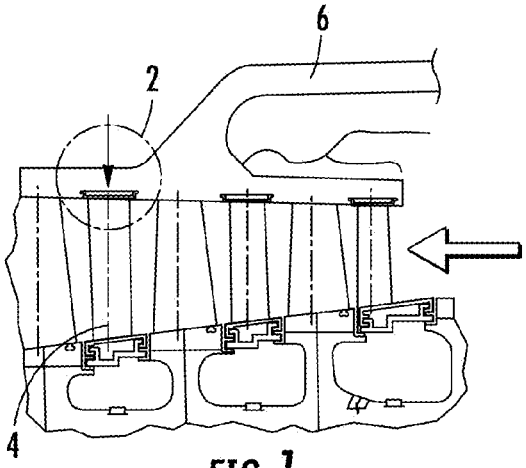
FIG. 1 (PRIOR ART)
FIG. 1 is cross-sectional side view of a compressor with a conventional turbine vane attachment system.

As shown in FIGS. 3-9, this invention is directed to a wear prevention system 10 for securing compressor airfoils 12 within a turbine engine 14 to reduce wear on diaphragm components 16 used to secure the compressor airfoils 12. Diaphragm bases 18 may be configured to support airfoils 12, such as compressor vanes, extending radially inward. In at least one embodiment, the wear prevention system 10 may be used in connection with compressor vanes 12 stage four through stage six. The diaphragm bases 18 may be contained within one or more airfoil receiving channels 20 in the compressor case 22. The diaphragm bases 18 may be biased radially inward within the airfoil receiving channel 20 though use of a compressor diaphragm spring 24. Use of the compressor diaphragm spring 24 reduces wear on the inner surfaces 26 of the airfoil receiving channel 20 of the compressor case 22 by dampening vibrations, thereby increasing the time between servicing outages.

The wear prevention system 10 may include a generally cylindrical compressor case 22 having one or more airfoil receiving channels 20. The airfoil receiving channel 20 may be positioned in an inner surface 28 of the generally cylindrical compressor case 22 such that the inner surface 28 includes an opening 30. The airfoil receiving channel 20 may extend at least partially around and in at least one embodiment, entirely around the compressor case 22. The airfoil receiving channel 20, thus, may be generally cylindrical and extend radially outward into the inner surface 28 of the compressor case 22. The airfoil receiving channel 20 may include one or more upstream recesses 32 and one or more downstream recess 34. The upstream recess 32 may be formed from a generally curved, upstream arm 36 that extends axially downstream and has an inner surface 38 that is aligned with and forms a portion of the inner surface 28 of the generally cylindrical compressor case 22. The downstream recess 34 may be formed from a generally curved, downstream arm 40 that extends axially upstream and has an inner surface 42 that is aligned with and forms a portion of the inner surface 28 of the generally cylindrical compressor case 22.

The wear prevention system 10 may include one or more diaphragm bases 18 for supporting the compressor airfoils 12 and securing the compressor airfoils 12 to the compressor case 22. The diaphragm base 18 may be curved about a longitudinal axis 78 and may extend from the upstream recess 32 to the downstream recess 34 with an upstream radially outward support surface 44 and a downstream radially outward support surface 46. A compressor airfoil 12 may extend radially inward from the diaphragm base 18. The diaphragm base 18 may include an upstream foot 33 configured to fit within the upstream recess 32 and a downstream foot 35 configured to fit within the downstream recess 34.

The wear prevention system 10 may also include a compressor diaphragm spring 24 positioned in the airfoil receiving channel 20 between a radially outer surface 48 of the diaphragm base 18 and a radially inner surface 26 of the airfoil receiving channel 20. The compressor diaphragm spring 24 may impart a force radially inward on the diaphragm base 18. The compressor diaphragm spring 24 may be deflected when installed, thereby creating a force directed on the diaphragm base 22.

In one embodiment, as shown in FIGS. 3, 4, 6 and 7, the compressor diaphragm spring 24 may extend axially from the upstream radially outward support surface 44 of the diaphragm base 18 to the downstream radially outward support surface 46 of the diaphragm base 18. The compressor diaphragm spring 24 may include an upstream inner support pad 50 that is configured to mate with the upstream radially outward support surface 44 and includes a downstream inner support pad 52 that is configured to mate with the downstream radially outward support surface 46. The upstream and downstream inner support pads 50, 52 may extend radially inward further than other aspects of the compressor diaphragm spring 24.

Figure 6:
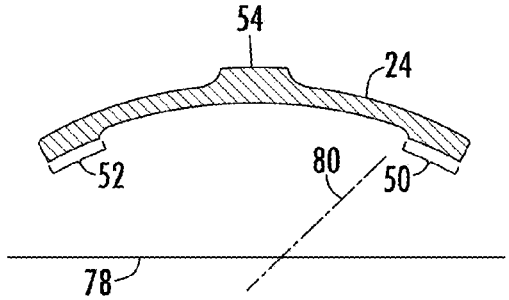
FIG. 6 is a cross-sectional side view of a compressor diaphragm spring.
Figure 7:
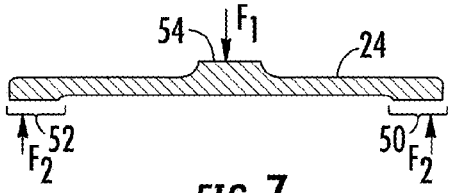
FIG. 7 is a cross-sectional side view of the compressor diaphragm spring shown in FIG. 6 with a load applied.
Figure 3:
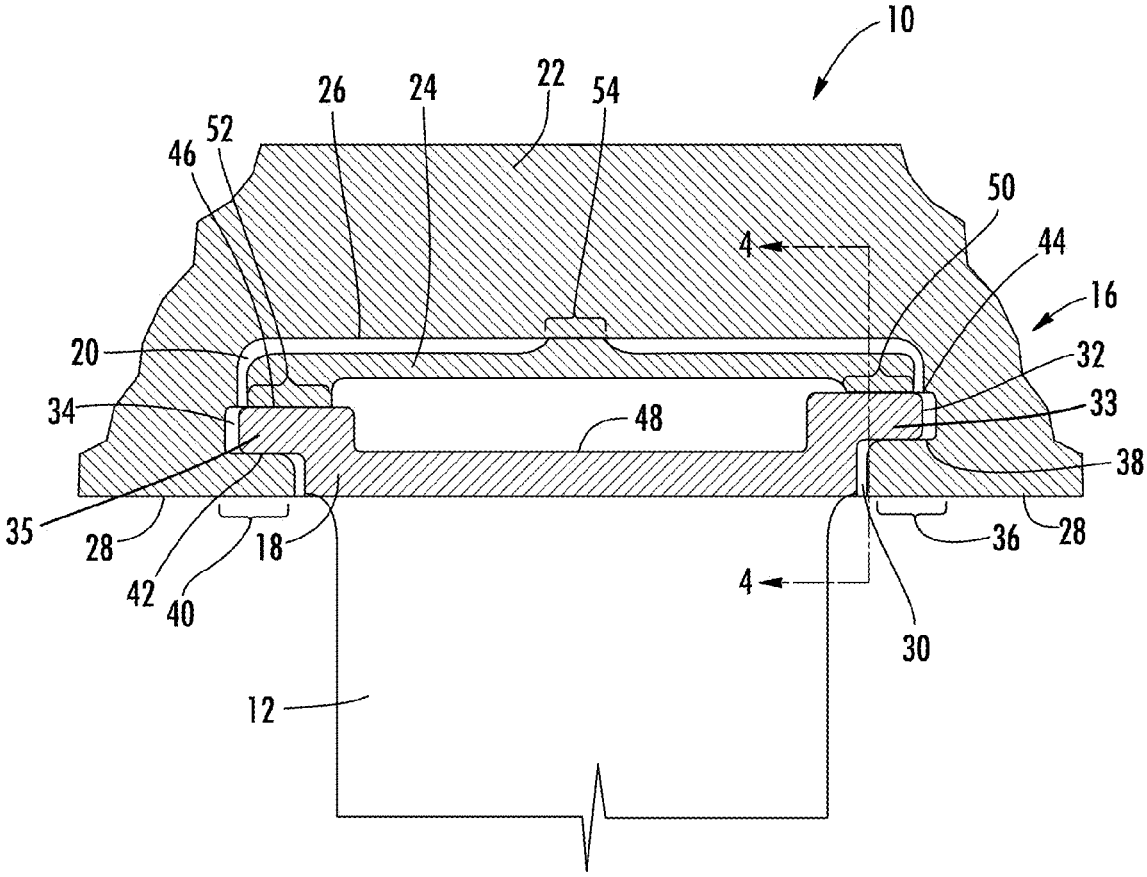
FIG. 3 is a detailed, cross-sectional view of an airfoil extending from a diaphragm base attached to a compressor case with a compressor diaphragm spring.
Figure 4:
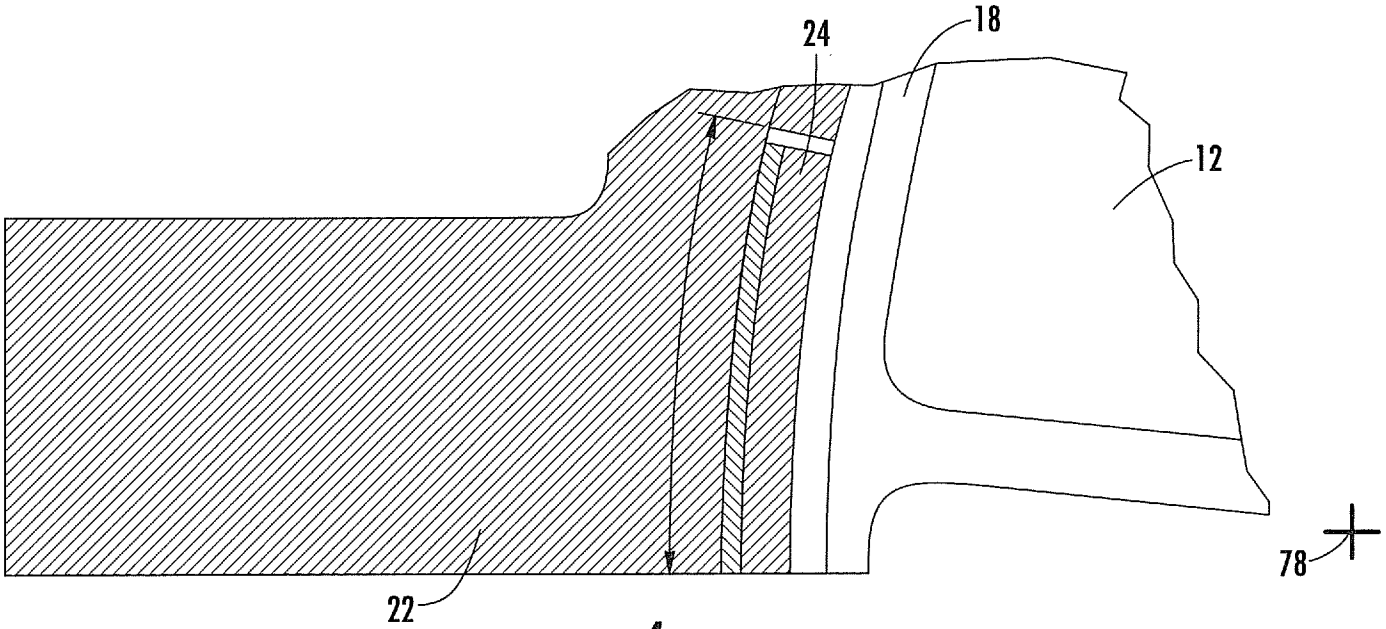
FIG. 4 is cross-sectional side view taken along section line 4-4 in FIG. 3.

A radially outward engagement pad 54 may extend radially outward from the compressor diaphragm spring 24. The radially outward engagement pad 54 may extend radially outward from the compressor diaphragm spring 24 further than other aspects of the compressor diaphragm spring 24. The radially outward engagement pad 54 may contact the radially inner surface 26 of the airfoil receiving channel 20. The radially outward engagement pad 54 may deflect radially inward when installed in the airfoil receiving channel 20 under a diaphragm base 18. The compressor diaphragm spring 24 may be curved about a longitudinal axis 78, as shown in FIG. 4, and may be curved about an axis 80 orthogonal to the longitudinal axis 78, as shown in FIG. 6.

Figure 8:
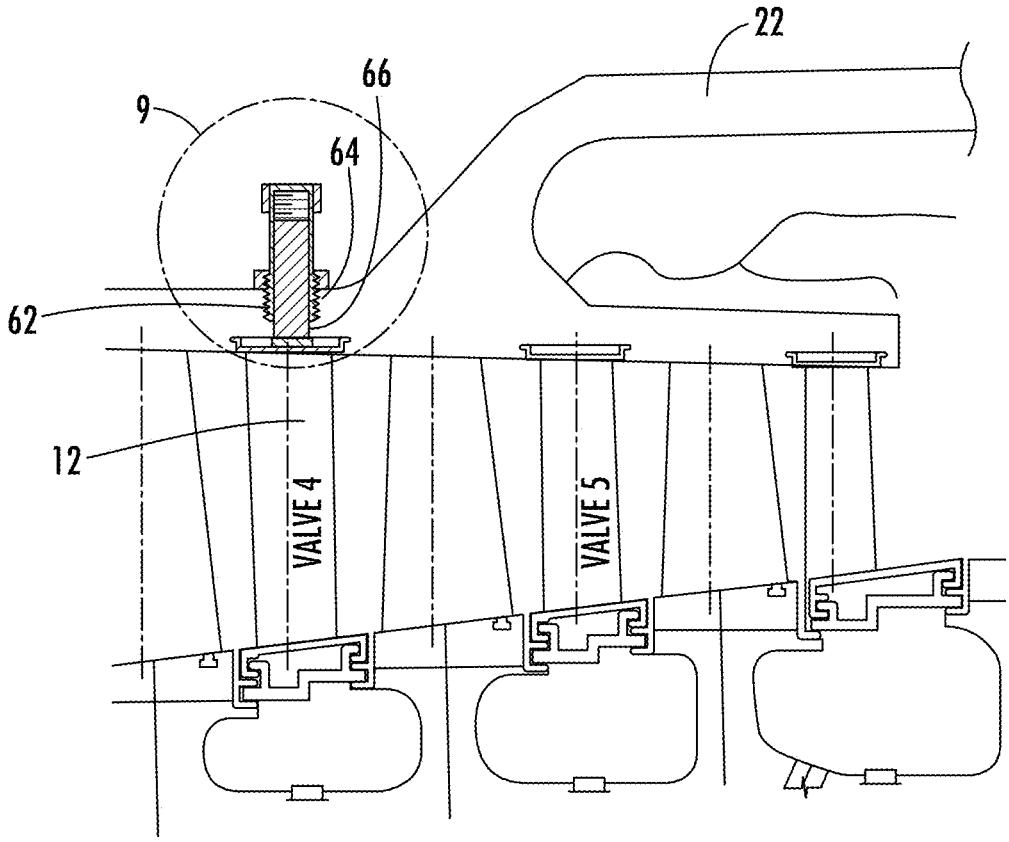
FIG. 8 is a cross-sectional side view of a compressor with another embodiment of the compressor diaphragm spring.
Figure 9:
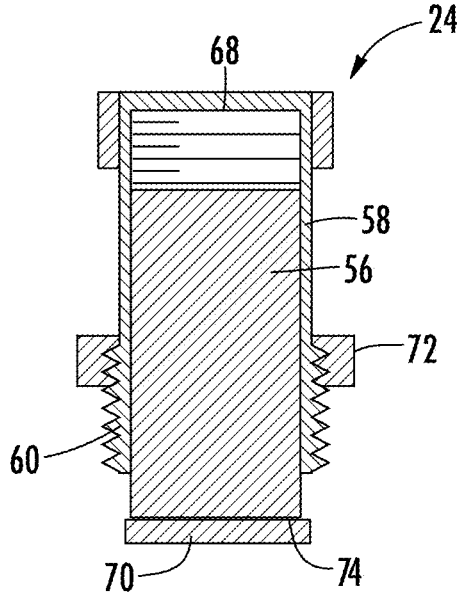
FIG. 9 is a detailed cross-sectional side view of the compressor diaphragm spring shown in FIG. 8 at detail line 9.

In another embodiment, as shown in FIGS. 8 and 9, the compressor diaphragm spring 24 may be formed from a rod 56 extending radially inward from the compressor case 22 into the airfoil receiving channel 20. The rod 56 may bias the diaphragm base 18 and the compressor airfoil 12 radially inward. A releasable housing 58 may contain at least a portion of the rod 56 and may be releasably attached to the compressor case 22. The releasable housing 58 may include a plurality of threads 60 extending axially outward that engage corresponding threads 62 on a sidewall 64 forming a chamber 66 through the compressor case 22. A sacrificial wear material 70 may be positioned on a radially inner surface 74 of the rod 56. A spring 68 may be positioned between the releasable housing 58 and a radially outer surface of the rod 56. The spring 68 may be, but is not limited to being, a coil spring. A jam nut 72 may be attached to the housing 58 thereby permitting a preloaded force to be applied to the spring 68.

Figure 5:
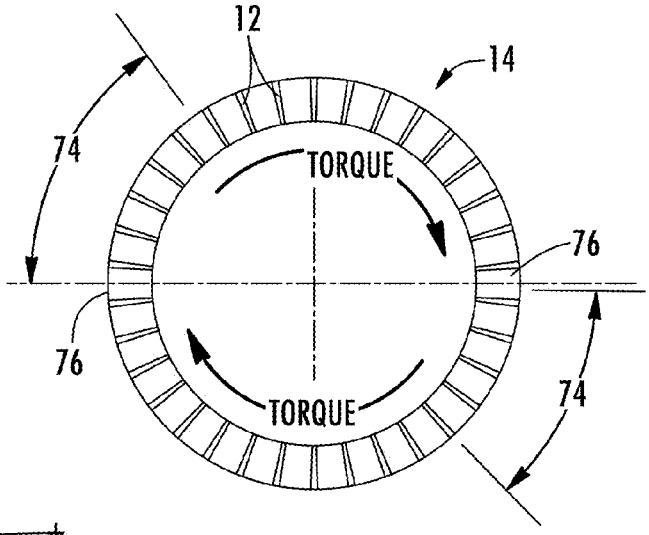
FIG. 5 is an axial view of stage four compressor airfoils in a compressor of the turbine engine.
Figure 2:
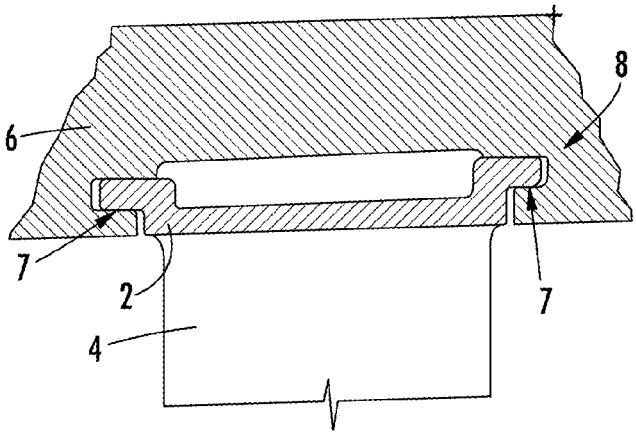
FIG. 2 (PRIOR ART)
FIG. 2 is a detailed, cross-sectional view of a prior art airfoil attached to a diaphragm, which is attached to a compressor case at detail line 2.

During use, the compressor diaphragm spring 24 may be positioned between the diaphragm base 18 and the inner surface 26 of the airfoil receiving channel 20. The compressor diaphragm spring 24 may be loaded at horizontal joints at four locations around the compressor case 22. The compressor diaphragm spring 24 may be deflected such that a radially inward force is imparted from the radially outward engagement pad 54 through the compressor diaphragm spring 24, through the upstream and downstream inner support pad 50, 52 and into the upstream and downstream radially outward support surfaces 44, 46. As such, the diaphragm base 18 and the attached compressor airfoils 12 are biased radially inward, thereby reducing the wear on the diaphragm base 18 and related components. FIG. 5 discloses the heavy wear regions 74 in close proximity to the case torque restraints 76.

In the embodiment shown in FIGS. 8 and 9, the compressor spring 24 may exert a force on the radially outer surface 48 of the diaphragm base 18. As such, the diaphragm base 18 and the attached compressor airfoils 12 are biased radially inward, thereby reducing the wear on the diaphragm base 18 and related components.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A wear prevention system for securing compressor airfoils within a turbine engine, comprising:

a generally cylindrical compressor case having at least one airfoil receiving channel, wherein the at least one airfoil receiving channel is positioned in an inner surface the generally cylindrical compressor case such that the inner surface includes an opening;

wherein the at least one airfoil receiving channel includes an upstream recess and a downstream recess;

wherein the upstream recess is formed from a generally curved, upstream arm that extends axially downstream and has an inner surface that is aligned with and forms a portion of the inner surface of the generally cylindrical compressor case;

wherein the downstream recess is formed from a generally curved, downstream arm that extends axially upstream and has an inner surface that is aligned with and forms a portion of the inner surface of the generally cylindrical compressor case;

at least one diaphragm base that is curved about a longitudinal axis and extends from the upstream recess to the downstream recess with an upstream radially outward support surface and a downstream radially outward support surface;

an airfoil extending radially inward from the at least one diaphragm base;

a compressor diaphragm spring positioned in the at least one airfoil receiving channel between a radially outer surface of the at least one diaphragm base and a radially inner surface of the at least one airfoil receiving channel;

wherein the compressor diaphragm spring imparts a force radially inward on the at least one diaphragm base;

wherein the compressor diaphragm spring is formed from a rod extending radially inward from the compressor case into the at least one airfoil receiving channel and wherein the compressor diaphragm spring is biased radially inward;

a releasable housing that contains at least a portion of the at least one rod and is releasably attached to the compressor case; and a sacrificial wear material positioned on a radially inner surface of the rod.

2. The wear prevention system of claim 1, further comprising a spring positioned between the releasable housing and a radially outer surface of the rod.

3. The wear prevention system of claim 2, wherein the spring is a coil spring.

4. The wear prevention system of claim 1, wherein the releasable housing includes a plurality of threads extending axially outward that engage corresponding threads on a side wall forming a chamber within the compressor case.

5. A wear prevention system for securing compressor airfoils within a turbine engine, comprising:

a generally cylindrical compressor case having at least one airfoil receiving channel, wherein the at least one airfoil receiving channel is positioned in an inner surface the generally cylindrical compressor case such that the inner surface includes an opening;

wherein the at least one airfoil receiving channel includes an upstream recess and a downstream recess;

wherein the upstream recess is formed from a generally curved, upstream arm that extends axially downstream and has an inner surface that is aligned with and forms a portion of the inner surface of the generally cylindrical compressor case;

wherein the downstream recess is formed from a generally curved, downstream arm that extends axially upstream and has an inner surface that is aligned with and forms a portion of the inner surface of the generally cylindrical compressor case;

at least one diaphragm base that is curved about a longitudinal axis and extends from the upstream recess to the downstream recess with an upstream radially outward support surface and a downstream radially outward support surface;

an airfoil extending radially inward from the at least one diaphragm base;

a compressor diaphragm spring positioned in the at least one airfoil receiving channel between a radially outer surface of the at least one diaphragm base and a radially inner surface of the at least one airfoil receiving channel;

wherein the compressor diaphragm spring imparts a force radially inward on the at least one diaphragm base;

wherein the compressor diaphragm spring is formed from a rod extending radially inward from the compressor case into the at least one airfoil receiving channel and wherein the compressor diaphragm spring is biased radially inward;

a releasable housing that contains at least a portion of the at least one rod and is releasably attached to the compressor case;

a spring positioned between the releasable housing and a radially outer surface of the rod; and wherein the releasable housing includes a plurality of threads extending axially outward that engage corresponding threads on a side wall forming a chamber within the compressor case and wherein a sacrificial wear material is positioned on a radially inner surface of the rod.

6. The wear prevention system of claim 5, wherein the spring is a coil spring.

* * * * *